US010615576B1

(12) United States Patent
Cress

(10) Patent No.: US 10,615,576 B1
(45) Date of Patent: Apr. 7, 2020

(54) SPARK PLUG

(71) Applicant: Caterpillar Inc., Deerfield, IL (US)

(72) Inventor: James Cress, West Lafayett, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/372,650

(22) Filed: Apr. 2, 2019

(51) Int. Cl.
*H01T 13/32* (2006.01)
*H01T 13/04* (2006.01)

(52) U.S. Cl.
CPC ..... *H01T 13/32* (2013.01); *H01T 13/04* (2013.01)

(58) Field of Classification Search
CPC ..... H01T 13/20–39
See application file for complete search history.

(56) References Cited

U.S. PATENT DOCUMENTS

| | | | | |
|---|---|---|---|---|
| 4,288,714 | A * | 9/1981 | Yamada | H01T 13/20 313/142 |
| 7,687,980 | B2 | 3/2010 | Kim | |
| 8,317,560 | B2 | 11/2012 | Hartmann et al. | |
| 9,397,481 | B2 | 7/2016 | Dirumdam | |
| 9,831,640 | B2 * | 11/2017 | Niessner | H01T 13/39 |
| 2011/0121713 | A1 * | 5/2011 | Ma | H01T 13/39 313/141 |
| 2014/0021853 | A1 * | 1/2014 | Shimizu | H01T 13/20 313/141 |
| 2014/0083386 | A1 * | 3/2014 | Dirumdam | H01T 13/32 123/169 EL |
| 2016/0363094 | A1 | 12/2016 | Luft et al. | |
| 2017/0331259 | A1 * | 11/2017 | Yamada | H01T 13/32 |
| 2019/0229501 | A1 * | 7/2019 | Niessner | H01T 13/39 |

FOREIGN PATENT DOCUMENTS

| | | | |
|---|---|---|---|
| CN | 204597221 | U | 8/2015 |
| CN | 104767123 | B | 1/2017 |
| DE | 102016105365 | A1 | 9/2016 |
| RU | 2281595 | C2 | 8/2006 |

* cited by examiner

*Primary Examiner* — Mariceli Santiago
(74) *Attorney, Agent, or Firm* — Procopio, Cory, Hargreaves & Savitch LLP

(57) ABSTRACT

The present disclosure relates to a spark plug for engines. The spark plug includes a center electrode and a ground electrode that includes a center void and a ground void respectively. An initial spark gap is formed between the center electrode and the ground electrode. A center electrode initial surface is disposed between the center void and the spark gap and a ground electrode initial surface is disposed between the ground void and the spark gap. The center void and ground void can become exposed through wear of the center electrode initial surface and ground electrode initial surface respectively. When the wear breaches center electrode initial surface and the ground electrode initial surface the wear creates a center first concentration edge and a ground first concentration edge that focus an electrical field and reduces the voltage required for fuel breakdown.

20 Claims, 4 Drawing Sheets

SPARK PLUG

TECHNICAL FIELD

The present disclosure generally pertains to engines. More particularly this application is directed toward a spark plug for an engine.

BACKGROUND

Spark plugs are used for electric ignition of a fuel mixture to be burned in an internal combustion engine. There is a spark gap between a center electrode and a ground electrode of a spark plug in which an electric ignition spark can be formed for igniting the fuel mixture.

U.S. Pat. No. 9,397,481 to Bjorn Dirumdam, describes a spark plug for an internal combustion engine, having a center electrode and a ground electrode. A spark gap is formed between the center electrode and ground electrode for igniting a fuel mixture by an electric ignition spark developing between the center electrode and the ground electrode. The center electrode and the ground electrode are contoured such that a ratio of a surface of the center electrode and the ground electrode, which is available for development of the ignition spark to a wear volume when an ignition spark is generated, is increased in such a way that an enlargement of the spark gap occurring as a result of wear when an ignition spark is generated is minimized.

The present disclosure is directed toward overcoming one or more of the problems discovered by the inventors.

SUMMARY

A spark plug for use with an engine is disclosed herein. The spark plug comprises a top end, a bottom end distal the top end, a ground electrode, a center electrode, and an initial spark gap between the electrodes. The ground electrode includes a plurality of ground voids disposed within the ground electrode. The center electrode is spaced from the ground electrode by an initial spark gap. The center electrode includes a plurality of center voids disposed within the center electrode, proximate to the initial spark gap.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent that those skilled in the art will be able to understand the disclosure without these specific details. In some instances, well-known structures and components are shown in simplified form for brevity of description. Some of the surfaces have been left out or exaggerated for clarity and ease of explanation.

The disclosure may reference a top direction or top and a bottom direction or bottom. Generally, references to the top direction and top are towards a top end 10 of the spark plug 100. Generally, references to the bottom direction and bottom are towards the bottom end 20 of the spark plug 100.

Figure 1:
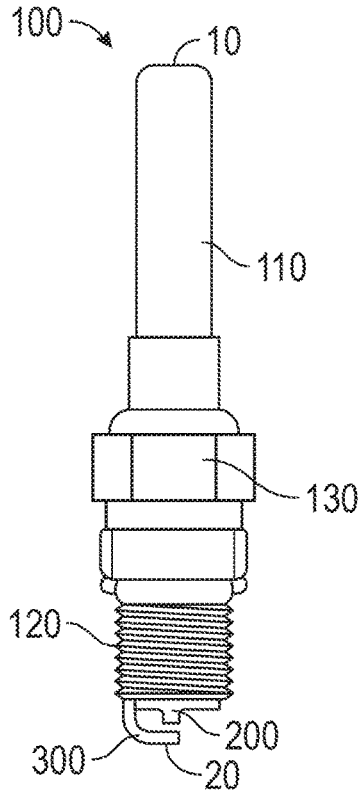
FIG. 1 is a side view of an exemplary spark plug.

FIG. 1 is a side view of an exemplary spark plug. A spark plug 100 can be used with an engine to facilitate ignition of an air/fuel mixture within a combustion chamber. The spark plug 100 can have an electrode 110 extending from a top end 10 to a center electrode 200, a bottom end 20 opposite the top end 10, and a plurality of external threads 120 that surround a periphery of the spark plug 100 proximate the bottom end 20. The threads 120 can be positioned between the body 130 and the bottom end 20. The threads 120 may be formed to provide for direct engagement with a cylinder head of an engine and provide for a grounded path with the cylinder head of the engine. The electrode 110 may be fabricated from an electrically conductive metal such as, tungsten, iridium, silver, platinum, and gold palladium, and be operable to direct current from a power supply to ionize (i.e., create a corona within) an air/fuel mixture in order to ignite the air/fuel mixture. The electrode 110 may extend through a body 130 of the spark plug 100 and can extend through the threads 120 and protrude beyond the threads 120 to form the center electrode 200. A ground electrode 300 may extend from the threads 120 to the bottom end 20. The center electrode 200 may be disposed proximate to the bottom end 20 and the ground electrode 300 such that current from the power supply may travel through electrode 110, to the center electrode 200, and further to the ground electrode 300, in order to create a spark to ignite the air/fuel mixture.

Figure 2:
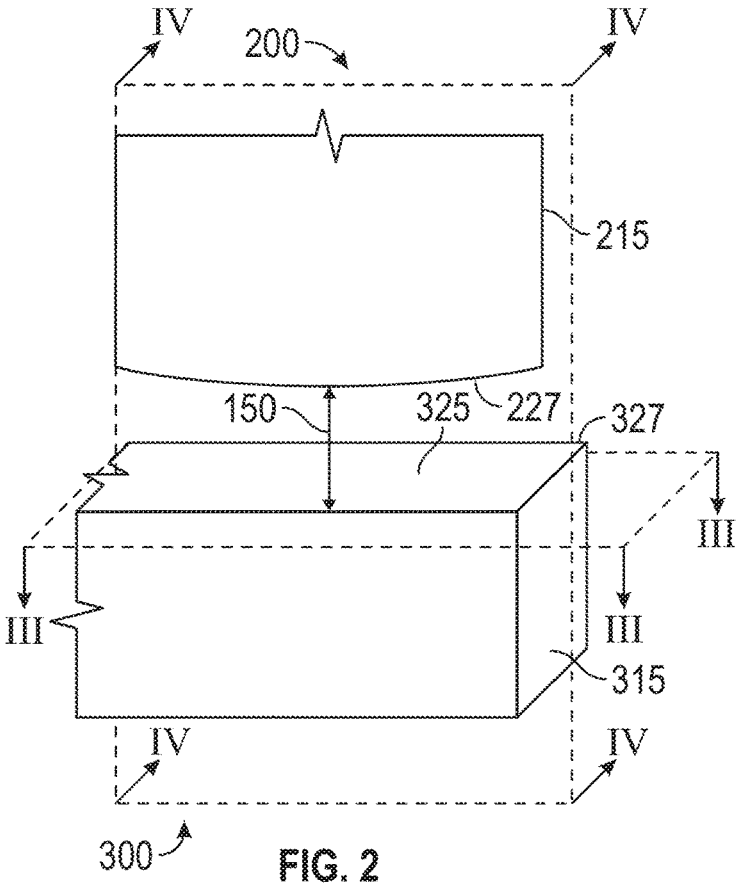
FIG. 2 is a simplified perspective illustration of portions of the center electrode and the ground electrode from FIG. 1.

FIG. 2 is a simplified perspective illustration of a portion of the center electrode and a portion of the ground electrode from FIG. 1. The center electrode 200 and the ground electrode 300 can be separated by an initial spark gap 150 proximate the bottom end 20. The initial spark gap 150 can have a wide range of values and may increase over time due to wear from electric discharges. The initial spark gap 150 can range from 0.004 inches to 0.040 inches. The initial spark gap 150 can range from 0.004 inches to 0.010 inches. The ground electrode 300 can be disposed at the bottom end 20 and include a ground perimeter surface 315, a ground initial surface 325, and a ground initial concentration edge 327. The ground initial surface 325 faces towards the center electrode 200 and the top end 10, and can be perpendicular to the initial spark gap 150. The ground initial surface 325 can have a rectangular shape. The ground perimeter surface 315 can be a surface portion of the ground electrode 300 that extends from the ground initial surface 325 away from the center electrode 200 and the top end 10, or in other words towards the bottom end 20. The ground perimeter surface 315 can be disposed perpendicular to the ground initial surface 325 and can be parallel with the initial spark gap 150. The interface between the ground initial surface 325 and ground perimeter surface 315 can form the ground initial concentration edge 327.

Similarly, the center electrode 200 can have a center perimeter surface 215, a center initial surface 225 (Shown in FIG. 4) and a center initial concentration edge 227. The center electrode 200 can be shaped, for example, as a cylinder or a frustoconical. The center electrode 200 can comprise a wide variety of volumetric shapes that are adequately formed to generate a spark. The center perimeter surface 215 can be a perimeter surface of the center electrode 200 that is perpendicular to the center initial surface 225. The center initial concentration edge 227 can be disposed opposite from the top end 10. The initial spark gap 150 can be the shortest distance between the center electrode 200 and ground electrode 300.

Figure 3:
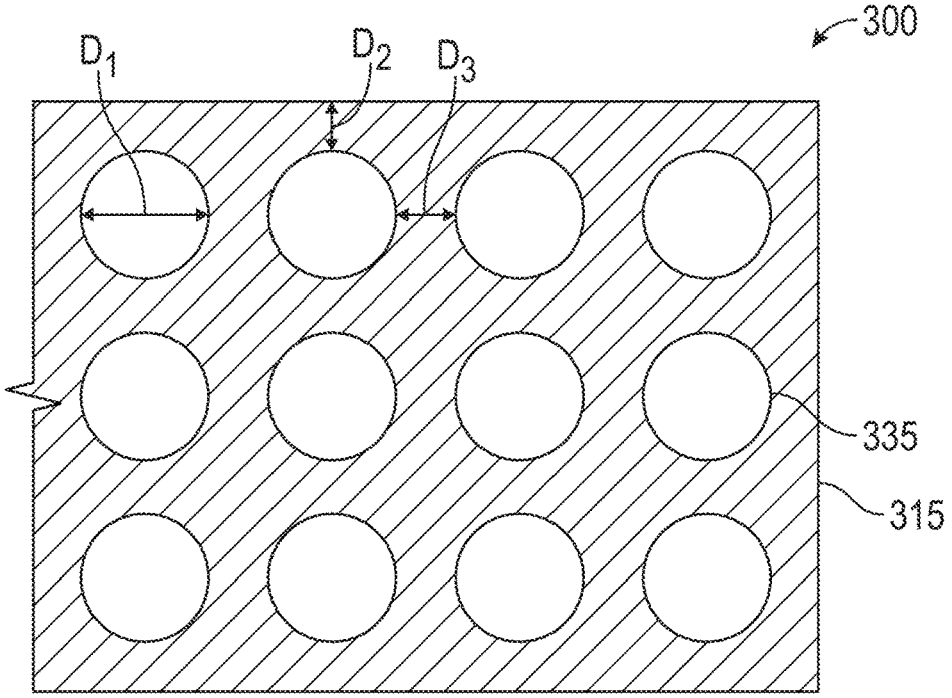
FIG. 3 is a cross section view of portions of the ground electrode in FIG. 2 along plane III-III.

FIG. 3 is a cross section view of the ground electrode in FIG. 2 along plane III-III. The ground electrode 300 can include ground voids 335 disposed. The ground voids 335 can be located within the ground electrode 300 as hollow cavities, opposite the bottom end 20. The ground voids 335 may not be in fluid communication with the surrounding environmental air. Each ground void 335 can be a sphere with a circular cross-section and with a ground void diameter D1. The ground voids 335 can be shaped, for example, as a cylinder, cone, spheroid, and other shapes that have circular or near circular, cross-sections. Additionally, the ground voids 335 can be shaped as other shapes that have curved outer surfaces. Further, the ground voids 335 can be in the form of other shapes. The ground voids 335 can each have equal ground void diameters D1 or have ground void diameters that vary in size. The ground void diameter D1 can range from 0.5 to 2.0 times the initial spark gap 150. The ground voids 335 can be oriented in a matrix, such as rows and columns. The columns can represent the ground voids 335 positioned in the left and right directions as shown on FIG. 3. The rows can represent the ground voids 335 positioned in the up and down directions as shown on FIG. 3. The shortest distance between a ground void 335 that is disposed proximate to the ground perimeter surface 315 and the ground perimeter surface 315 is represented by a distance D2. The distance D2 can be proportional to the ground void diameter D1 and range from 0.25 to 1.00 times the ground void diameter D1. The distance D2 can be proportional to the initial spark gap 150 and range from 0.125 to 2.0 times the initial spark gap 150. The shortest distance between a ground void 335 and an adjacent ground void 335 is represented by a distance D3. The distance D3 can be proportional to the ground void diameter D1 and range from 0.25 to 1.00 times the ground void diameter D1. The distance D3 can be proportional to the initial spark gap 150 and range from 0.125 to 2.0 times the initial spark gap 150.

Though not shown in a similar cross-section, the center electrode 200 can include voids with similar characteristics disclosed above with regards to the ground electrode shown in FIG. 3. It is appreciated that the description of the features shown in FIG. 3 can also be applied to similar features of the center electrode 200.

Figure 4:
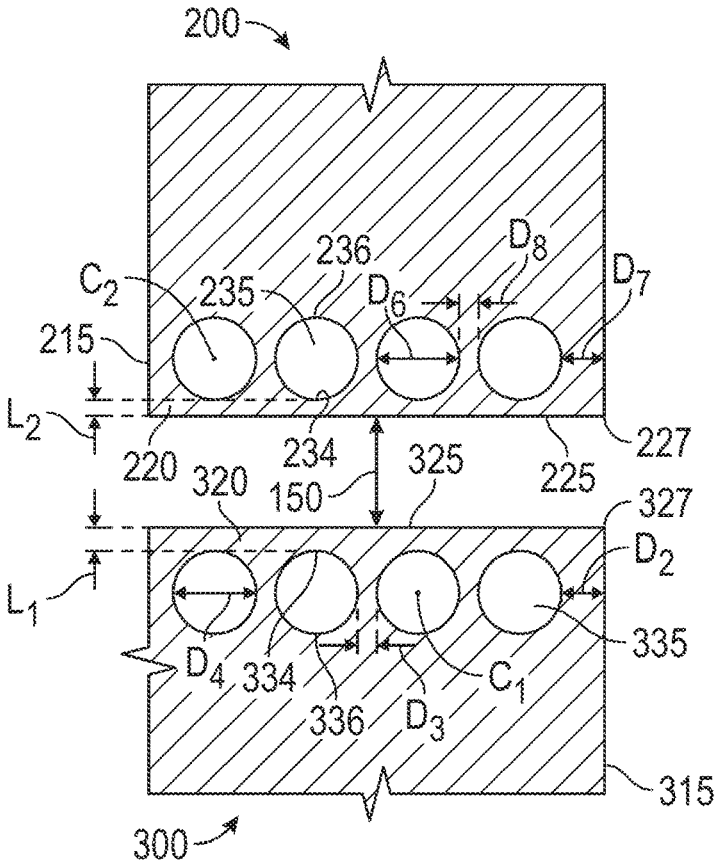
FIG. 4 is a cross section view of portions of the center electrode and ground electrode from FIG. 2 along plane IV-IV.

FIG. 4 is a cross section view of the center electrode and ground electrode from FIG. 2 along plane IV-IV. The initial spark gap 150 is shown as the distance between the ground initial surface 325 and the center initial surface 225 and can be the shortest distance between the ground electrode 300 and the center electrode 200.

The ground electrode 300 includes the ground voids 335 disposed proximate to the ground initial surface 325. The ground voids 335 can include a ground void bottom end 336 and a ground void top end 334. The ground void top end 334 can be disposed opposite to the bottom end 20 at the top of the ground base portion 330. The ground void bottom end 336 can be disposed opposite to the ground void top end 334 at the bottom end of the ground void 335. The ground voids 335 can be positioned in a plane that is perpendicular to the ground initial surface 325. The ground voids 335 can each comprise a spherical shape, spheroid shape, conical shape, or a cylindrical shape extending into the page. The ground voids 335 can comprise other shapes as noted above in connection with the ground voids 335.

Each ground void 335 can have a circular cross-section with a ground void diameter D4. The ground voids 335 can each have equal ground void diameters D4 or have ground void diameters D4 that vary in size. The ground void diameter D4 can range from 0.5 to 2.0 times the initial spark gap 150. The ground voids 335 can have a center C1. The ground voids 335 can generally be oriented in a signal layer such that the center C1 of each ground void 335, does not vary between in the top direction or bottom direction more than ½ of their diameter D4 in comparison to the center of another ground void 335. In other words, the ground void 335 may be staggered and not in a straight line.

The ground electrode 300 can include a ground initial region portion 320 that can extend from the edge of the ground voids, such as from the ground void top end 334, towards the top direction and the center electrode 200. The ground initial region portion 320 can have a ground initial surface 325 facing the top direction and center electrode 200. The distance between the ground initial surface 325 and the ground void top end 334 is represented by a ground initial length L1. In other words the ground initial length L1 is the shortest distance between the ground voids 335 and the ground initial surface 325. The ground initial length L1 can be proportional to the initial spark gap 150 and can range from 0.25 to 0.75 times the initial spark gap 150.

The center electrode 200 can include a center initial surface 225. The center initial surface 225 faces towards the ground electrode 300 and the bottom end 20, and can be perpendicular to the initial spark gap 150. The center perimeter surface 215 can be a surface portion of the center electrode 200 that extends from the center initial surface 225 away from the ground electrode 300 and the initial spark gap 150. The interface between the center initial surface 225 and center perimeter surface 215 can form the center initial concentration edge 227. The center initial concentration edge 227 can also be shaped like a rectangle.

The center electrode 200 can include the center voids 235 disposed proximate to the bottom end of the center electrode 200. The center voids 235 can be disposed within the center electrode 200 as hollow cavities. In some embodiments the center voids 235 are initially (prior to wear) not in fluid communication with the surrounding environmental air. The center voids 235 can include a center void bottom end 234 and a center void top end 236. The center void bottom end 234 can be disposed at the bottom end of the center electrode 200 proximate to the initial spark gap 150. The center void top end 236 can be disposed opposite to the center void bottom end 234 at the top end of the center void 235. The center voids 235 can be positioned in a plane perpendicular to the center initial surface 225. The center voids 235 can each comprise a spherical shape, spheroid shape, conical shape, or a cylindrical shape. The center voids 235 can comprise other shapes such as similar shapes of the ground voids 335 as was described above.

Each center void 235 can have a circular cross-section with a center void diameter D6. The center voids 235 can each have equal center void diameters D6 or have center void diameters that vary in size. The center void diameter D6 can equal the ground void diameter D4 or the two diameters can vary in size. The center void diameter D6 can range from 0.5 to 2.0 times the initial spark gap 150. The center voids 235 can have a center C2. The center voids 235 can generally be oriented in a signal layer such that the center C2 of each center void 235, does not vary between in the top direction 10 or bottom direction more than ½ of their diameter D6 in comparison to the center C2 of another center void 235. In other words, the center void 235 may be staggered and not in a straight line.

The shortest distance between a center void 235 that is disposed proximate to the center perimeter surface 215 is represented by a distance D7. The distance D7 can be proportional to the center void diameter D6 and range from 0.25 to 1.00 times the center void diameter D6. The distance D7 can be proportional to the initial spark gap 150 and range from 0.125 to 2.0 times the initial spark gap 150. The shortest distance between a center void 235 and an adjacent center void 235 is represented by a distance D8. The distance D8 can be proportional to the center void diameter D6 and range from 0.25 to 1.00 times the center void diameter D6. The distance D8 can be proportional to the initial spark gap 150 and range from 0.125 to 2.0 times the initial spark gap 150.

The center electrode can include a center initial region portion 220 that can extend from the edge of the center voids 235, such as the center void bottom end 234, towards the bottom direction. The center initial region portion 220 can have a center initial surface 225 facing the bottom direction and ground electrode 300. The distance between the center initial surface 225 and the center void bottom end 234 is represented by a center initial length L2. In other words the center initial length L2 is the shortest distance between the center voids 235 and the center initial surface 225. The center initial length L2 can be proportional to the initial spark gap 150 and can range from 0.25 to 0.75 times the initial spark gap 150.

Figure 5:
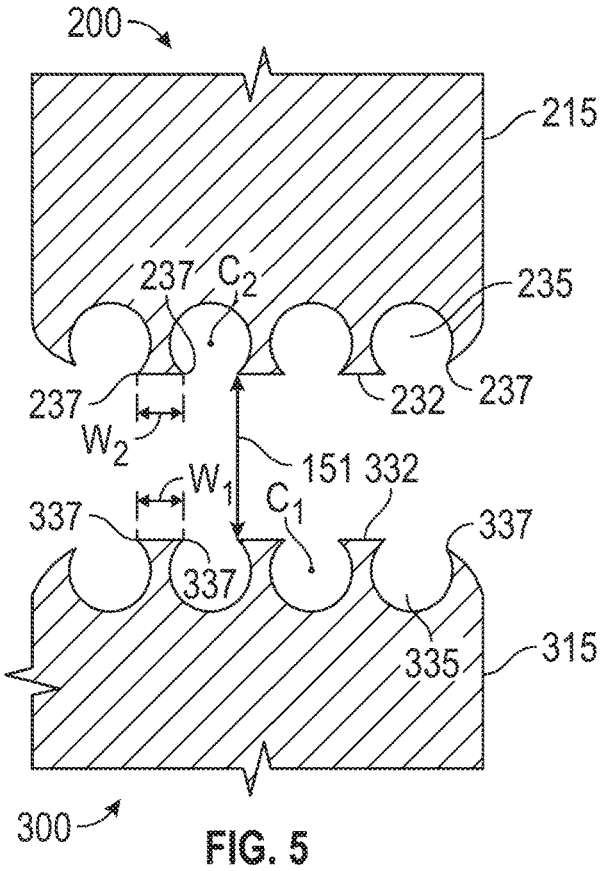
FIG. 5 is the cross section view of portions of the center electrode and ground electrode from FIG. 4 after wear.

FIG. 5 is a cross section view of the center electrode and ground electrode from FIG. 4 after some wear. The ground initial region portion 320 and center initial region portion 220 can be worn down from electrical discharges generated by the spark plug 100 over time. FIG. 5 shows an example of the wear extending through the ground initial region portion 320 and center initial region portion 220 and into the ground electrode 300 and the center electrode 200. The wear can expose the ground voids 335 and the center voids 235 to the combustion chamber. Additionally, new edges and surfaces can be formed including a ground first wear surface 332 and a center first wear surface 232. The ground first wear surface 332 is disposed at the top of the ground electrode 300. Ground first wear concentration edges 337 can be formed at the connection of the ground void 335 and the ground first wear surface 332 as well as at the connection of the ground first wear surface 332 and the ground perimeter surface 315. The ground first wear surface 332 can have a ground first wear width W1 that is the measured width of the ground first wear surface 332. The ground first wear width W1 can also represent the distance between two ground first wear concentration edges 337 from two adjacent ground voids 335.

The center first wear surface 232 is disposed at the bottom of the center electrode 200. Center first wear concentration edges 237 can be formed at the connection of the center void 235 and the center first wear surface 232 as well as at the connection of the center first wear surface 232 and the center perimeter surface 215. The center first wear surface 232 can have a center first wear width W2 that is the measured width of the center first wear surface 232. The center first wear width W2 can also represent the distance between two center first wear concentration edges 237 from two adjacent center voids 235.

The initial spark gap 150 has increased to the first wear spark gap 151, which can be the distance between the ground first wear surface 332 and the center first wear surface 232 or the distance between the ground first wear concentration edges 337 and the center first wear concentration edges 237.

Figure 6:
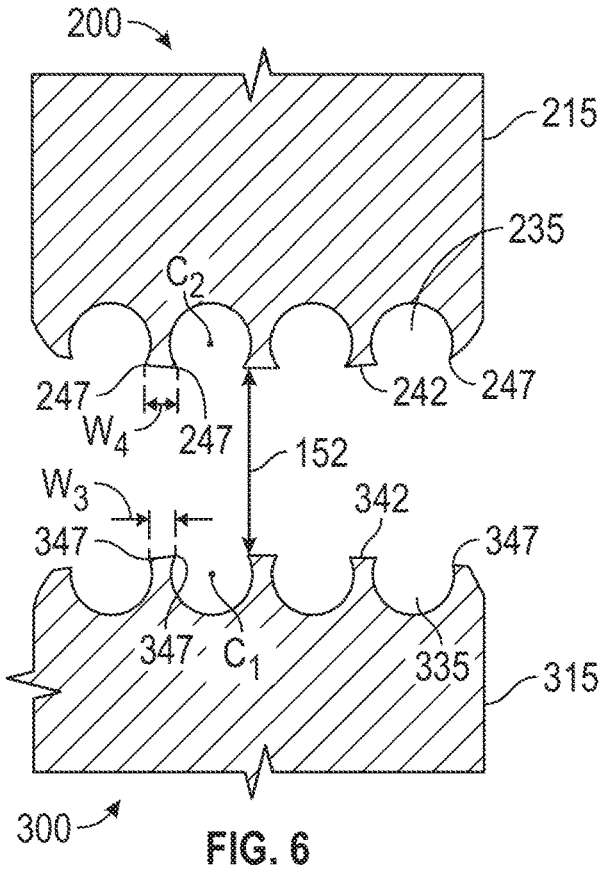
FIG. 6 is the cross section view of portions of the center electrode and ground electrode from FIG. 5 after more wear.

FIG. 6 is a cross section view of the center electrode and ground electrode from FIG. 5 after more wear. The ground electrode 300 and the center electrode 200 can be further worn down from electrical discharges experienced by the spark plug 100 over time. The wear can further extend towards the ground void center of curvature C1 and the center void center of curvature C2.

Additionally, new edges and surfaces can be formed including a ground second wear surface 342 and a center second wear surface 242. The ground second wear surface 342 is the disposed at the top end of the ground electrode 300. Ground second wear concentration edges 347 can formed at the connection of the ground void 335 and the ground second wear surface 342 as well as at the connection between the ground second wear surface 342 and the ground perimeter surface 315. The ground second wear surface 342 can have a ground second wear width W3 that is the measured width of the ground second wear surface 342. The ground second wear width W2 can also represent the distance between two ground second wear concentration edges 347 from two adjacent ground voids 335.

The center second wear surface 242 is the disposed at the bottom end of the center electrode 200. Center second wear concentration edges 247 can be formed at the connection of the center void 235 and the center second wear surface 242 as well as at the connection of the center second wear surface 242 and the center perimeter surface 215. The center second wear surface 242 can have a second wear width W4 that is the measured width of the center second wear surface 242. The center second wear width W4 can also represent the distance between two center second wear concentration edges 247 from two adjacent center voids 235.

The first wear spark gap 151 has increased to the second wear spark gap 152, which can be the distance between the ground second wear surface 342 and the center second wear surface 242 or the distance between the ground second wear concentration edges 347 and the center second wear concentration edges 247.

Figure 7:
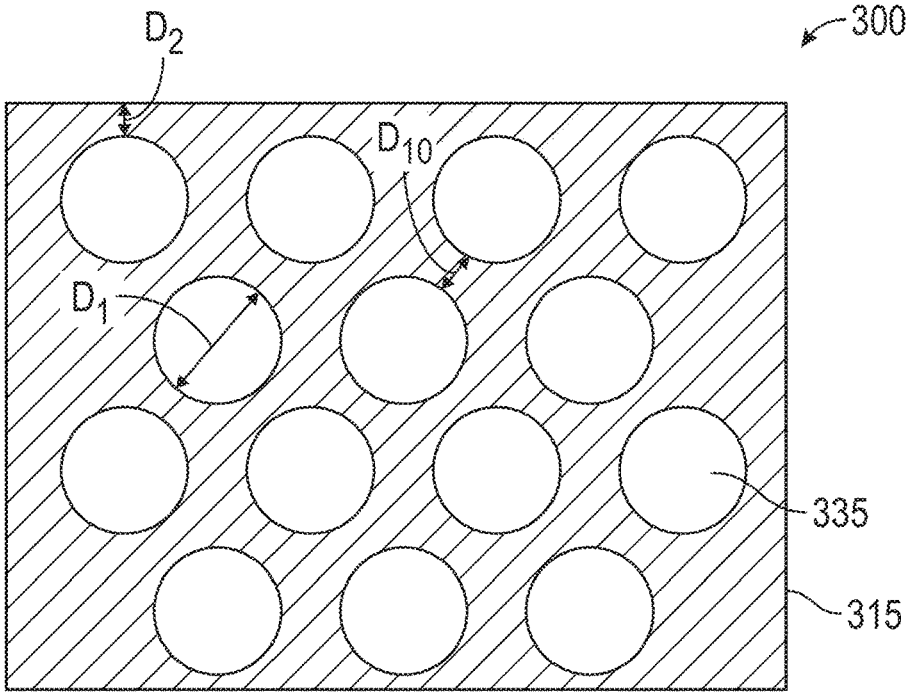
FIG. 7 is a cross section view of a portion of an exemplary ground electrode with an alternative ground void orientation.

FIG. 7 is a cross section view of an exemplary ground electrode with an alternative ground void orientation. The ground voids 335 can be oriented in a matrix, such as diagonal rows. The ground voids 335 are positioned on diagonals or in a staggered formation, allowing for a more densely pack configuration in comparison to orientation in FIG. 3. The closest distance between adjacent ground voids 335 may not be in the left and right directions or the up and down directions, but in a diagonal direction. The shortest distance between a ground void 335 and an adjacent ground void 335 can be represented by a distance D10. The distance D10 can be proportional to the ground void diameter D10 and range from 0.25 to 1.00 times the ground void diameter D1. The distance D10 can be proportional to the initial spark gap 150 and range from 0.125 to 2.0 times the initial spark gap 150.

Figure 8:
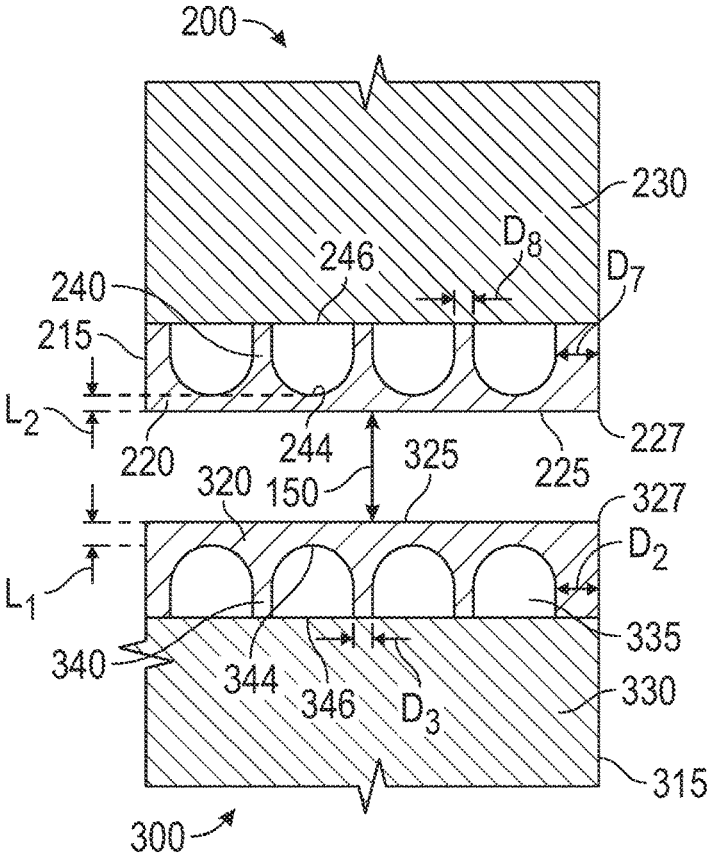
FIG. 8 is a cross section view of a portion of the center electrode and ground electrode from FIG. 2 along plane IV-IV with voids of alternative geometry.

FIG. 8 is a cross section view of the center electrode and ground electrode from FIG. 2 along plane IV-IV with voids of alternative geometry. The ground electrode 300 can have two portions; a ground base portion 330 and a ground void portion 340. The ground void portion 340 can include ground voids 345 and be disposed the ground base portion 330 and the initial spark gap 150. The ground base portion 330 and ground void portion 340 can be made of the same material or different material. The ground void portion 340 can be connected to the ground base portion 330 and extend from the ground base portion 330 towards the center electrode 200.

The ground voids 345 and the center voids 245 can be similar to the ground voids 335 and center voids 235, with a different cross-sectional geometry. The ground voids 345 can be shaped as a half circle connected to a rectangular base cross section that is rotated 360 degrees along its vertical axis. The ground voids 345 can have a ground void top end 344 and a ground void bottom end 346. The ground void top end 344 can be disposed opposite to the bottom end 20 at the top of the ground electrode 300. The ground void bottom end 346 can be disposed opposite to the ground void top end 344 at the bottom end of the ground void 335.

Similarly, the center electrode 200 can have two portions; a center base portion 230 and a center void portion 240. The center void portion 240 can include center voids 245 and be disposed the center base portion 230 and the initial spark gap 150. The center base portion 230 and center void portion 240 can be made of the same material or different material. The center void portion 240 can be connected to the center base portion 230 and extend from the center base portion 230 towards the ground electrode 300.

The center voids 245 can have a cross-section shaped as a half circle connected to a rectangular base that is rotated 360 degrees along its vertical axis. The center voids 245 can be shaped as a cross-section shaped as a half circle connected to a rectangular base that extends into the page. The center voids 245 can have a center void top end 246 and a center void bottom end 244. The center void bottom end 244 can be disposed opposite to the top end 10 at to the bottom of the center electrode 200. The center void top end 246 can be disposed opposite to the center void bottom end 244 at the top of the center void 235.

INDUSTRIAL APPLICABILITY

The surfaces of the center electrode and ground electrode build up an electric field at concentration points. These concentration points are subject to wear when an ignition spark is generated. As a result of this wear, the concentration points of the center electrode and ground electrode can become rounded and reduce the intensity of the electric field generated. When the electric field intensity is reduced enough, the spark plug must be exchanged.

The disclosed spark plug 100 can help increase the electrical field concentrations rather than diminish the electrical field concentrations as the center electrode 200 and ground electrode 300 experience wear during use.

The spark plug 100 includes voids such as ground voids 335, 345 and center voids 235, 245 that can be hollow cavities position adjacent to respective initial region portions 220, 320. In an embodiment, the voids 235, 245, 335, 345 are not initially in fluid communication with environmental air or if installed, a combustion chamber. As the center electrode 200 and ground electrode 300 experience surface erosion from electric discharge, the ground initial region portion 320 and the center initial region portion 220 are worn through and the voids 235, 245, 335, 345 become exposed to the combustion chamber and increase the number of concentration edges. The newly created concentration edges can include ground first concentration edges 337, ground second concentration edges 338, center first concentration edges 237, and center second concentration edges 238. The concentration edges 237, 238, 337, 338 focus the electric field and reduce the voltage required for fuel break down in the combustion chamber.

The voids 235, 245, 335, 345 can be added to the ground electrode 300 and center electrode 200 and arranged in a single layer perpendicular to the ground initial surface 325 and center initial surface 225. These voids 235, 245, 335, 345 can be shaped as spheres, spheroids, cylinders, or other volumetric shapes in the ground electrode 300 and center electrode 200. The curved shaped of the voids 235, 245, 335, 345 allows sharp edges to form as the electrodes 200, 300 wear. With multiple voids 235, 245, 335, 345 arranged adjacent to each other and by utilizing a curved shaped, the electric fields can further intensify as the wear increases. For example, the ground first wear width W1 is larger than the ground second wear width W3 and the center first wear width W2 is larger than the center second wear width W4. In other words, as the wear approaches the shortest distance between the voids, distance D3 and distance D8, the electrode 200, 300 material width between the voids 235, 245, 335, 345 reduces.

The ground electrode 300 and center electrode 200 can include multiple parts including the ground base portion 330, the ground void portion 340, the center base portion 230, and the center void portion respectively 240. The voids 235, 245, 335, 345 can be machined into the ground void portion 340 and the center void portion 240 respectively, prior to being attached to the ground base portion 330 and the center base portion 330. This can help facilitate machining a wide variety of void 235, 245, 335, 345 volume geometries into the electrodes 200, 300.

Although this invention has been shown and described with respect to detailed embodiments and examples thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of engine. For example, the described embodiments may be applied to generators, engines, machinery, equipment, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. It is appreciated that features shown or discussed in one embodiment or example can be combined with other features shown or discussed in other embodiments and examples. The embodiments are not limited to those that solve any or all of the stated problems or those that have any or all of the stated benefits and advantages.

What is claimed is:

1. A spark plug for use with an engine, the spark plug comprising:

a top end;

a bottom end distal the top end;

a ground electrode disposed proximate the bottom end, having a plurality of ground voids disposed within the ground electrode and disposed opposite of the bottom end;

a center electrode disposed between the ground electrode and the top end, having a plurality of center voids disposed within the center electrode and disposed proximate to the ground base electrode; and an initial spark gap disposed between the ground electrode and the center electrode.

2. The spark plug of claim 1, wherein the ground electrode further comprises:

a ground initial surface disposed adjacent the spark gap and a ground initial region portion extending from the plurality of ground voids to the ground initial surface; and the center electrode further comprises:

a center initial surface disposed adjacent the spark gap and a center initial region portion extending from the plurality of center voids to the center initial surface.

3. The spark plug of claim 2, wherein the plurality of center voids and the plurality of ground voids are shaped to form center first wear concentration edges and ground first wear concentration edges respectively after wear through the center initial region portion and the ground initial region portion.

4. The spark plug of claim 1, wherein the plurality of center voids have a center void diameter that measures between 0.5 and 2.0 times the initial spark gap and the plurality of ground voids have a ground void diameter that measures between 0.5 and 2.0 times the initial spark gap.

5. The spark plug of claim 4, wherein the plurality of center voids and plurality of ground voids are spherically shaped.

6. The spark plug of claim 2, wherein the plurality of center voids are arranged in a single layer perpendicular to the center initial surface and the plurality of ground voids are arranged in a single layer perpendicular to the ground initial surface.

7. The spark plug of claim 2, wherein the plurality of the center voids are arranged to be exposed through wear of the center initial region portion.

8. A spark plug for use with an engine, the spark plug comprising:

a top end;

a bottom end distal the top end;

a body disposed between the top end and bottom end;

a plurality of threads between the body and the bottom end a ground electrode extending from the plurality of threads towards the bottom end, having a plurality of ground voids disposed within the ground electrode; and a center electrode spaced from the ground electrode by an initial spark gap, having a plurality of center voids disposed within the center electrode proximate the initial spark gap.

9. The spark plug of claim 8, wherein the plurality of center voids have a center void diameter between 0.5 and 2.0 times the initial spark gap and the plurality of ground voids have a ground void diameter between 0.5 and 2.0 times the initial spark gap.

10. The spark plug of claim 8, wherein the ground electrode further comprises:

a ground initial surface disposed adjacent the spark gap and a ground initial region portion extending from the plurality of ground voids to the ground initial surface; and the center electrode further comprises:

a center initial surface disposed adjacent the spark gap and a center initial region portion extending from the plurality of center voids to the center initial surface.

11. The spark plug of claim 10, wherein the distance between the ground initial surface and the plurality of ground voids is between 0.25 to 0.75 times the initial spark gap and the distance between the center initial surface and the plurality of center voids is between 0.25 to 0.75 times the initial spark gap.

12. The spark plug of claim 10, wherein the plurality of center voids are arranged in a single layer perpendicular to the center initial surface and the plurality of ground voids are arranged in a single layer perpendicular to the ground initial surface.

13. The spark plug of claim 10, wherein the plurality of center voids and plurality of ground voids are shaped to form center first wear concentration edges and ground first wear concentration edges respectively after wear through the center initial region portion and the ground initial region portion.

14. The spark plug of claim 10, wherein the plurality of the ground voids are arranged to be exposed through wear of the ground initial region portion.

15. A spark plug for use with an engine, the spark plug comprising:

a top end;

a bottom end distal the top end;

a center electrode disposed proximate the bottom end, having a center initial surface disposed opposite the top end, a center initial region portion extending from the center initial surface towards the top end, and a plurality of center voids arranged to be exposed through wear of the center initial region; and a ground electrode spaced from the center electrode by an initial spark gap, having a ground initial surface disposed adjacent the spark gap, a ground initial region portion extending from the ground initial surface away from the initial spark gap, and a plurality of ground voids arranged to be exposed through wear of the ground initial region portion.

16. The spark plug of claim 15, wherein the plurality of the center voids have a center void diameter between 0.5 and 2.0 times the initial spark gap.

17. The spark plug of claim 16, wherein the plurality of ground voids have a ground void diameter between 0.5 and 2.0 times the initial spark gap.

18. The spark plug of claim 15, wherein the distance between the ground initial surface and the plurality of ground voids is between 0.25 to 0.75 times the initial spark gap.

19. The spark plug of claim 15, wherein the distance between the center initial surface and the plurality of center voids is between 0.25 to 0.75 times the initial spark gap.

20. The spark plug of claim 17, wherein adjacent ground voids of the plurality of ground voids are spaced at a distance between 0.25 and 1.00 times the ground void diameter and adjacent center voids of the plurality of center voids are spaced at a distance between 0.25 and 1.00 times the center void diameter.

* * * * *